United States Patent [19]

Williams

[11] Patent Number: 4,640,204

[45] Date of Patent: Feb. 3, 1987

[54] FLUIDIZED BED COMBUSTION APPARATUS AND METHOD OF OPERATING SAME

[75] Inventor: Robert M. Williams, Ladue, Mo.

[73] Assignee: Williams Patent Crusher and Pulverizer Company, St. Louis, Mo.

[21] Appl. No.: 871,856

[22] Filed: Jun. 9, 1986

[51] Int. Cl.[4] ..... F23D 1/00

[52] U.S. Cl. ..... 110/347; 110/232; 110/245; 241/34

[58] Field of Search ..... 110/347, 245, 232, 263; 241/34

[56] References Cited

U.S. PATENT DOCUMENTS

| | | | |
|---|---|---|---|
| 2,172,317 | 9/1939 | Dickey | 83/44 |
| 4,249,470 | 2/1981 | Vatsky | 110/232 |
| 4,397,248 | 8/1983 | Mehta et al. | 110/232 X |
| 4,461,428 | 7/1984 | Williams | 241/34 |
| 4,552,076 | 11/1985 | McCartney | 110/232 X |

OTHER PUBLICATIONS

Achieving the Promise of FBC, EPRI Journal, Jan.-/Feb. 1985, pp. 7-15.

Special Report—Fluidized-Bed Boilers Achieve Commerical Status Worldwide, Power, Feb. 1984, pp. S.1-S.16.

"They're Off!", in the circulating FBC handicap, Coal Mining, Nov. 1985, pp. 49-52.

*Primary Examiner*—Edward G. Favors

*Attorney, Agent, or Firm*—Gravely, Lieder & Woodruff

[57] ABSTRACT

A fluidized bed combustion apparatus in which the combustion chamber has a dense fuel bed created in the chamber, and a grinding mill connected to the dense fuel bed portion of the chamber and so operated as to classify the material into fine and coarse particulates with the fines being directed into the bottom of the dense fuel bed and the coarse particulates being directed to the top of the dense fuel bed. The apparatus is placed under the control of a controller which regulates the mill to feed fines and coarse particulates in proportions for maintaining optimum average particle size and hence optimize boiler efficiency.

11 Claims, 5 Drawing Figures

FLUIDIZED BED COMBUSTION APPARATUS AND METHOD OF OPERATING SAME

BACKGROUND OF THE INVENTION

1. Field of the Invention

This invention is particularly directed to an improved fluidized bed combustion apparatus and to a method for rendering the operation of such apparatus economical.

2. Description of the Prior Art

It is known that fluidized bed combustion of coal is the subject of current study by many organizations manufacturing and supplying to the industry variations in the type of fluidized bed combustion apparatus.

Papers have been authored on this subject, such as one by Taylor Moore under the title "Achieving the Promise of FBC", appearing in EPRI Journal, January/February 1985 (pages 6–15), and the Special Report that appeared in Power, February 1985, entitled "Fluidized-Bed Boilers Achieve Commercial Status Worldwide", by Schweiger, Editor-in-Chief (pages S-1 to S-16, and the article by Leon Green Jr. which appeared in Coal Mining, November 1985, entitled "They're Off" in the circulating FBC handicap.

In the prior patent art there appeared a suggestion of supplying pulverized fuel to a boiler in the Dickey U.S. Pat. No. 2,172,317 issued Sept. 5, 1939. The concept of producing two products, fines and coarse, from coal processing apparatus has been disclosed by Williams in U.S. Pat. No. 4,461,428 of July 24, 1984.

It is recognized that the problem in fluid bed combustion chambers at the present time is how to burn different types of wet coal without carbon loss through escape of coal fines and without plugging the feed system with the wet fines.

BRIEF DESCRIPTION OF THE INVENTION

An important object of the present invention is to provide a method of operating fluidized bed coal combustion and coal grinding apparatus by prestripping the fines in the grinder and injecting fine particulate coal near the bottom of a dense bed zone of burning coal, and to introduce the remaining coarse particulate stripped of its fines near the top of the dense bed zone of burning coal so the fine particulate fractions of the coal must travel through the dense bed zone and gain sufficient time in that bed so the fines do not escape from the system and result in the loss of carbon fuel value.

Another important object of the present invention is to inject the relative fine particulate coal into the dense bed zone of the combustion chamber in a cyclonic manner to obtain substantially complete combustion of the fines by using the centrifugal mixing force to create turbulence in the dense bed zone.

Still a further object of the present invention is to provide a control system for governing the operation of fluid bed combustion and coal grinding apparatus so the average particle size of the coal fed to the combustion zone can be controlled and the proportion of coarse and fine particulate material may be adjusted to improve combustion efficiency.

An embodiment of the present invention designed to overcome the present known problems provides apparatus that practices the method of reducing the 2"×0 coal and directly feeding it to a combustion chamber in a stream of fines and a separate stream of coarse fractions so both streams can be controlled and drying air can be used to transport the fines. The embodiment avoids the need for storage equipment and circumvents wet coal problems.

Other objects will appear in the more detailed disclosure of the embodiments to be disclosed.

BRIEF DESCRIPTION OF THE DRAWINGS

The apparatus employed to carry out the conception of the present invention is seen in the following drawings, wherein.

DETAILED DESCRIPTION OF THE EMBODIMENTS

Prior to my invention the apparatus for feeding coal to boiler combustion apparatus included one or several stages of crushing the raw coal, and conveyor means to move the crushed coal to a storage bunker. The crushed coal consists of a composition of fine and coarse fractions, and when the crushed coal is wet the fine fractions plugged the outlet or the feeder so the combustion process was unreliable or interrupted. In addition, introducing the fines along with the coarse coal at the top of the dense bed column increases the chance that the fines would fly out of the combustion chamber and report to the cyclone creating a problem by uncontrolled overheating as the fines would burn in the cyclone, or if not burned in the cyclone would escape to the outlet system and report to a bag house as unburned carbon. That problem area is overcome and avoided by the present unique apparatus and its method of operation. Instead of precrushing the coal and storing it, the coal of about 2"×0 size is fed directly into a roller mill that has the ability to reduce the coal into fine particulate fractions and coarse particulate fractions. These two presized fractions of coal are introduced to the combustion apparatus at different locations or levels in a dense bed column wherein the coarse fractions enter at the top and create the dense bed in the column, and at the same time fine fractions are injected into the dense bed column at the bottom or a low level, and are combusted due to longer retention in the dense bed.

Figures 1, 5:
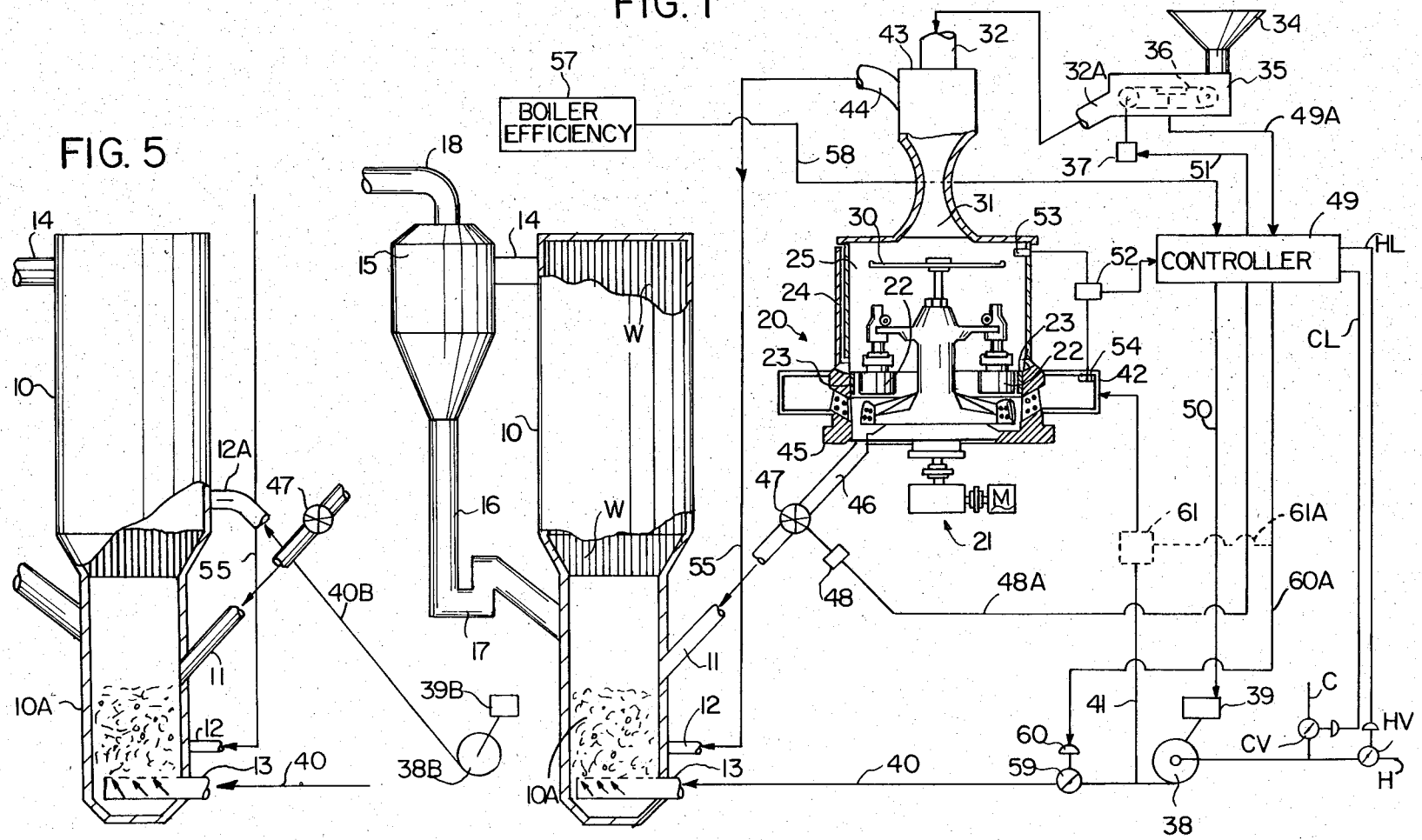
FIG. 1 is a schematic view of a system, partly in fragmentary section, showing an arrangement of components governing the operation of combustion apparatus in which coarse and fine proportions of coal can be burned under improved combustion efficiency.
FIG. 5 is a fragmentary modification of the schematic system seen in FIGS. 1 and 2.

The apparatus seen in FIG. 1 is characterized by an elongated combustion chamber 10 having a suitable water wall W to produce steam for commercial purposes. The chamber 10 contains a dense bed column 10A in which combustion is generated to develop an operating temperature in the chamber 10 of about 1600° F. The dense bed column 10A is supplied with coarse coal particulate fractions at the inlet 11, and the fine coal particulate fractions are supplied at the injector 12. Combustion supporting air is supplied to the column 10A at the air distributor 13. The products of combustion leaves the chamber 10 at the outlet 14 and enters a cyclone separator 15 where the particulate matter of unburned or partially burned coal is separated and returns by gravity through conduit 16 to a return leg 17 connected into the chamber 10A. The hot gases are exhausted from the cyclone separator 15 at conduit 18 and can be connected into heat exchange means (not a part of the invention) which has an exhaust that is usually connected to a bag house (not shown) of known character where any residual matter is captured.

The source of the fine and coarse fractions of coal is found in a coal reducing roller mill 20 of the character disclosed in my co-pending application Ser. No. 852,983, filed Apr. 16, 1986. Such mill 20 is operated by a suitable drive including a gear transmission 21 operated by motor M driving the grinding rollers 22 in a grinding chamber defined by the usual bull ring 23. The upper interior space of the roller mill housing 24 encloses a centrifugal spinner plate 30 which is aligned with the venturi feed tube 31 to direct the incoming coal from the feed pipe 32 initially onto the spinner plate 30 where the centrifugal action moves the large and fine particulate outwardly into the annular space 25 so the fines are lifted and stripped from the coarse particulates which fall by gravity through the annular space 25 and proceed into the grinding chamber for reduction. The supply of coal reaching the feed pipe 32 comes from a supply bunker 34 which feeds the coal into an enclosure 35 where it falls onto a weigh belt apparatus 36 driven by a suitable motor 37 to deliver the weighed amount of coal to the outlet 32A which is connected to the pipe 32. The weigh belt has a sensor 36A connected by lead 49A to controller 49.

A supply of hot drying air is introduced to the system by fan 38 driven by motor 39 which delivers such air into concuit 40 and a portion of that air is split off by a control valve 59 and flows through conduit 41 to enter the roller mill bustle 42 where the hot drying air at velocity will strip the fine particulate matter entering at the pipe 32 into the roller mill outlet stack 43 where it enters the outlet delivery conduit 44. Hot drying air from line H tempered by ambient or other air admitted at line C can have a temperature of from 400° F. to 900° F., depending upon the drying requirements. Suitabe motor operated valves HV and CV are provided, subject to controller 49 through control leads HL and CL respectively. It can be seen that the roller mill 20 has an outlet port 45 in the bottom of the grinding chamber, which port opens to an exhaust pipe 46 equipped with a rotary air lock device 47 driven by motor 48. Therefore, as depicted in FIG. 1, the roller mill 20 delivers the coal fine particulate fraction propelled by the drying air at delivery conduit 44 and delivers its coarser size particulate matter through the conduit 46.

The system of FIG. 1 is provided with a controller 49 which is responsive to the fuel requirements of the combustion chamber 10 which is a boiler for producing steam in its water walls. A boiler efficiency device 57 signals the controller 49 to drive the feeder motor 37 to feed coal from the weigh belt 36 to the mill in response to the device 57. The coal processing by the mill 20 is independent of the boiler demand and is only responsive to the differential pressure measuring device 52 which has a sensor 53 in the upper space of the mill housing 24 and a cooperating sensor 54 located conveniently in the air bustle 42 so as to measure the differential pressure across the grinding chamber which is a function of the quantity of coal in the grinding chamber of the mill 20.

The outputs 44 and 45 from mill 20 are connected to the zone 10A of the boiler chamber 10 whereby coarse fractions enter at or near the top of the dense bed zone or column 10A, while the fine fractions are directed by conduit 55 to the injector 12 located near the bottom of the dense bed zone or column. Combustion air supply means is embodied in conduit 40 supplied from the blower 38 and is connected at the distributor 13 so the air flows upwardly through the dense bed column creating the fluidizing effect. The fine particulate coal will be substantially consumed as the result of its residence time in the dense bed column which thereby avoids its loss through the cyclone separator outlet 18. The means supplying air into the coal processing mill 20 is the conduit 41 which receives air from the fan 38 at its connection into the conduit 40 in advance of the control valve 59 which can be positioned to create a back pressure so air will flow into conduit 41, as is well understood.

What is shown schematically in FIG. 1 is a combination of apparatus wherein the original supply of coal from the bunker 34 freely enters the mill stack 43, even through it may be wet, where the air flows upwardly from the air bustle 42 and strips and drys the fines as the incoming coal falls onto the spinner plate 30 causing it to move into the annular space 25. The heavier coarse coal falls into the grinding chamber where it can be dried and ground to the proper size and exits at the outlet 45. The fines created in the grinding chamber are stripped and flow upwardly to the mill stack outlet 44. Known technology allows boiler efficiency 57 to be measured as various types or grades of coal are introduced into the combustion chamber 10. It has been proven that as the coal BTU per pound drops, to maintain boiler efficiency, the average particulate size in the fluid bed column must be reduced. Hence, the poorer the coal BTU per pound the smaller the average size of the particulate must be to optimize the boiler efficiency. Variations in the sensed boiler efficiency transmitted from the sensor 57 to the controller 49 will cause the controller, independently of the operation of the mill 20, to increase or decrease the making of a predetermined average size of fine particulate by adjusting the air flow in conduit 41 by reducing the speed of the fan motor 39 or opening the valve 59, and/or by slowing the speed of the air lock motor 48 to slow the exit of the coarse particulate fractions. It is recognized that motor 38 receives control signals through lead 50, and the motor 38 at the air lock 47 receives control signals through lead 48. Alternatively, the predetermined average particulate size can be adjusted by discharging more of the coarse fractions at the outlet 45 to flow to the upper end of the dense bed column 10A by speeding up the air lock motor 48 and decreasing the air flow. The average particle size from a good grade of coal (50% passing) is about 3000 microns, whereas a poorer grade of coal may require a size of about 300 microns. In the system of FIG. 1 it is preferred that about 94% of the air from the air supply means 40 should flow to the distributor 13 and the balance of about 6% should flow to the bustle 42 at the mill 20.

Figures 2, 3, 4:
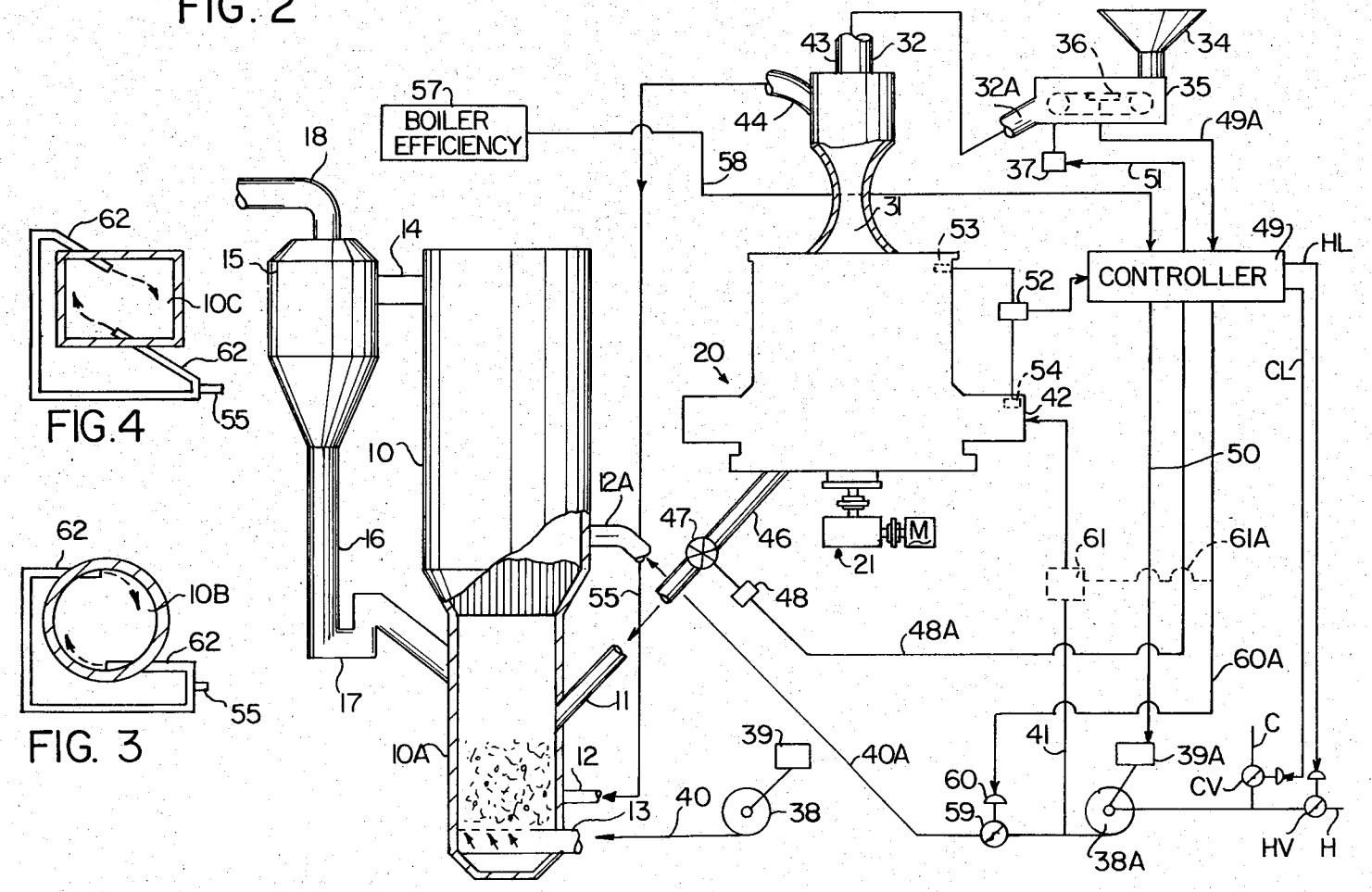
FIG. 2 is a fragmentary view of a portion of the schematic system seen in FIG. 1 illustrating an important modification.
FIG. 3 is a fragmentary sectional detail of the injecting means for introducing fines into the dense bed zone of FIGS. 1 or 2.
FIG. 4 is a modification of the injecting means adapted for combustion apparatus of other than circular.

The view of FIG. 2 includes many of the components above described in FIG. 1. In order to avoid repetition of much of the description, only fragmentary parts are referred to in relation to the modifications which are important. Similar components will be denoted by the previously employed numerals with a suffix letter where necessary. The essential modifications include relying on the fan 38 to constitute the air supply means through line 40 to the air distributor 13, and to provide means to supply air at conduit 41 from air supply fan 38A driven by its motor 39A. In addition the conduit 40A directs the fan air output to a secondary air supply inlet 12A in the area above the dense bed. The secondary air promotes further and more complete combustion and the fluidizing turbulence which is experienced in the dense bed column is changed into a rapid flow that enters the outlet 14. In the modification system of FIG. 2 the primary air supply means from fan 38 can be set to supply about 65% of the air needed for primary combustion which is acceptable for commercial boiler practice. About 12% of the air flow is directed by conduit 41 to the mill 20 and the balance of about 23% of the air goes to the secondary inlet 12A.

Attention is directed to FIG. 3 which is a representation of an alternative arrangement for providing tangential injectors 62 in the dense fuel bed column 10B for directing the air flow from conduit 55 into that column, thereby cyclonicly subjecting the fine particulate fraction supplied through the injector 62 to an improved agitation within the dense fuel bed column 10B.

FIG. 4 is a further alternate arrangement, but is directed to a dense fuel bed column 10C of a rectangular cross section, and that configuration requires a rearrangement of injectors 62 in angularly opposed relationship and out of direct alignment for achieving the same improved agitation within the dense column.

The foregoing apparatus can be operated in one of two ways. In one way the method is to divert a portion of the air from the fan 38, or 38A into the conduit 41 and deliver it to the mill 20 so as to effect the drying and stripping of the fines from the coarse particulate matter. In this method a control damper 58 is needed in the air flow line 40 so as to effect the diversion of the air flow into conduit 41. The damper has a drive motor 60 subject to control by the controller 49.

An alternate method of operation of the above described apparatus can be effected by incorporating an alternate fan at the location 61 in the air flow conduit 41 so as to divert a quantity of air from the conduit 40 in response to the operation of the alternate air fan 61. In this method the damper 59 is not required in the air flow conduit 40, and the damper motor control 60A must be rerouted by line 61A to the alternate fan 61.

The fragmentary view of FIG. 5 illustrates only so much of the drawings of FIGS. 1 and 2 as is necessary to understand that the fan 38B driven by motor 39B supplies secondary air to the combustion chamber through conduit 40B connected into the inlet 12A. The abbreviated showing of conduit 40 is to indicate that the details of connection to the fan 38 and related components is to be repeated, along with the mill 20 and associated components disclosed in FIG. 1.

Having described what is presently included in the preferred embodiments of apparatus, as well as methods of its operation, it should now be apparent to those skilled in the pertinent art that modifications in arrangement and detail may occur without departing from the principles of the invention which have been illustrated in the accompanying drawings.

What is claimed is:

1. In a coal burning boiler having a dense bed column with a closed end and opening into a combustion chamber, and a source of coal, the improvement comprising:

(a) coal processing mill means adapted to receive coal from said source and having a first outlet conduit connected to said dense bed column adjacent the closed end and a second outlet conduit connected to said dense bed column spaced from said connection of said first outlet conduit to said dense bed column;

(b) means supplying air into said coal processing mill means for stripping fine particulate fractions and delivering the same into said first outlet conduit for injection into said dense bed column;

(c) means in said second outlet conduit connection operable to feed coarse particulate fractions into said dense bed column for supplying coarse coal fractions into said column spaced from said injection of fines into said column; and (d) air supply means connected into said dense bed column adjacent said closed end of said dense bed column for fluidizing the fine and coarse coal fractions in said dense bed column.

2. The improvement set forth in claim 1 wherein said first outlet conduit from said coal processing mill injects the fine particulate fractions into said dense bed column substantially cyclonically.

3. The improvement set forth in claim 1 wherein drive means is connected to said means in said second outlet conduit to control the feeding of coarse particulate fractions into said dense bed column.

4. The improvement set forth in claim 1 wherein said means supplying air into said coal processing mill is connected to a source of hot drying air for drying the fine particulate fractions stripped from the coal.

5. The improvement set forth in claim 1 wherein drive means is connected to said means supplying air into said processing mill; other drive means is connected to said means in said second outlet conduit; and controller means is operably connected to said drive means and said other drive means for adjusting the rate of supply of air to said processing mill and rate of discharge of the coarse particulate fractions from said coal processing mill for obtaining a predetermined average size of fine particulate fractions to maintain a predetermined boiler efficiency level.

6. A method of operating a fluidized bed coal combustion apparatus for a boiler having a combustion chamber containing a dense fuel bed column, and a mill for processing a supply of coal, said method comprising:

(a) admitting air to said mill to classify the coal into fine and coarse fractions;

(b) connecting the mill to the dense fuel bed column of the combustion chamber for moving the fine fractions to the chamber for admission to the dense fuel bed column;

(c) connecting the mill to the combustion chamber for adding the coarse fractions upon the dense fuel bed column; and (d) supplying air to said dense fuel bed column for fluidizing the fractions therein.

7. The method set forth in claim 6 and including subjecting the products of combustion created in the combustion chamber to cyclonic separation of the particulates from the gas; and returning the particulate to the combustion chamber.

8. The method set forth in claim 6 and including controlling the proportions of fine and coarse fractions of coal admitted to the combustion chamber for maintaining a substantially uniform combustion efficiency in said chamber.

9. Fluidized bed coal combustion apparatus comprising in combination:

(a) a vertically elongated combustion chamber having a bottom end closed by a dense bed coal column and a combustion particulate and gas outlet spaced above said column;

(b) a source of coal;

(c) a coal processing mill having a coal inlet means, separate coal fine outlet and coarse coal outlet; and an air inlet;

(d) conduit means connecting said mill fine coal outlet with said dense bed column adjacent the bottom of said column and other conduit means connecting said separate coarse coal outlet with the top of said dense bed column;

(e) air moving means having a connection with said combustion chamber and with said coal processing mill at said air inlet; and (f) a control system connected to said coal combustion apparatus for governing the operation thereof to supply the fine and coarse coal particulate in predetermined proportions for substantially optimizing the efficiency of the combustion apparatus.

10. The apparatus set forth in claim 9 wherein said air moving means has a connection with said combustion chamber above the dense bed column for the introduction of secondary air thereto.

11. The apparatus set forth in claim 9 wherein said air moving means includes a primary air connection with said combustion chamber and a separate secondary air connection with said combustion chamber.

* * * * *